US010283831B2

(12) United States Patent
Hendry

(10) Patent No.: US 10,283,831 B2
(45) Date of Patent: May 7, 2019

(54) TRIPLE MODE SPHERE RADIO FREQUENCY FILTERS

(71) Applicant: Nokia Solutions and Networks Oy, Espoo (FI)

(72) Inventor: David R. Hendry, Auchenflower (AU)

(73) Assignee: Nokia Solutions and Networks Oy, Espoo (FI)

( * ) Notice: Subject to any disclaimer, the term of this patent is extended or adjusted under 35 U.S.C. 154(b) by 104 days.

(21) Appl. No.: 15/361,908

(22) Filed: Nov. 28, 2016

(65) Prior Publication Data

US 2018/0151932 A1 May 31, 2018

(51) Int. Cl.

| | |
|---|---|
| ***H01P 1/208*** | (2006.01) |
| ***H01P 7/10*** | (2006.01) |
| ***H01P 1/20*** | (2006.01) |
| ***H01P 1/201*** | (2006.01) |
| ***H01P 1/202*** | (2006.01) |
| ***H01P 7/06*** | (2006.01) |

(52) U.S. Cl.

CPC ..... *H01P 1/2086* (2013.01); *H01P 1/201* (2013.01); *H01P 1/2002* (2013.01); *H01P 1/202* (2013.01); *H01P 1/2082* (2013.01); *H01P 7/06* (2013.01); *H01P 7/105* (2013.01)

(58) Field of Classification Search

CPC .... H01P 1/2002; H01P 1/2084; H01P 1/2086; H01P 7/10; H01P 7/105; H01P 1/201; H01P 1/202

USPC ..... 333/202, 208, 209, 212

See application file for complete search history.

(56) References Cited

U.S. PATENT DOCUMENTS

| | | | | |
|---|---|---|---|---|
| 4,410,865 | A | 10/1983 | Young et al. | |
| 5,229,729 | A * | 7/1993 | Nishikawa | H01P 7/10 333/126 |
| 5,731,750 | A | 3/1998 | Tatomir et al. | |
| 2005/0047451 | A1 | 3/2005 | Johnson | |
| 2011/0006856 | A1 * | 1/2011 | Kim | H01P 1/2086 333/134 |

OTHER PUBLICATIONS

Lai Sheng-Li et al IF2 I-3, A five Mode Single Spherical Cavity Microwave Filter; 1992.

(Continued)

*Primary Examiner* — Rakesh B Patel

(74) *Attorney, Agent, or Firm* — Harrington & Smith

(57) ABSTRACT

An RF filter includes: an electrical conductor defining an outer sphere; a dielectric material defining an inner sphere disposed within the conductor outer sphere; and at least a first electrical probe and a second electrical probe. Each probe extends through the conductor and is electrically insulated from it. A spherical shape of one or both of the inner and outer spheres is interrupted by: a) a first localized discontinuity in said spherical shape disposed along a first axis passing through a geometric center of the one or both of the inner and outer spheres; and b) a second localized discontinuity in said sphere form disposed along a second axis passing through the geometric center, the second axis perpendicular to the first axis. There can be more than these two discontinuities, implemented as chamfers, tuning screws, and the like. Series and parallel coupling of the spheres is detailed.

16 Claims, 12 Drawing Sheets

(56) References Cited

OTHER PUBLICATIONS

Michael N. Jones The Symmetric Perturbation of a Spherical Cavity; 1967.
Park Nam-Shin et al Compact Triple-Mode Bandpass Filter Using Spherical Dielectric Resonator; 2013.
The Black Hole Filter by the KMW Company of Hwasung, Korea; see http://www.kmw.co.kr/eng/product/product_new_3.html, last visited Nov. 17, 2016).
The Seven-pole UMTS filter by Radio Frequency Systems of Meriden, CT, USA (see http://www.rfsworld.com/stayconnected/index.php?p=657&I=1&listName=stayconnected_en_articles&indexVal=67 last visited Nov. 17, 2016).

* cited by examiner

TRIPLE MODE SPHERE RADIO FREQUENCY FILTERS

TECHNOLOGICAL FIELD

The described invention relates to frequency selective filters, and more particularly radio frequency (RF) filters such as band pass filters used in wireless communications equipment such as base transceiver stations (BTSs) and user equipments (UEs).

BACKGROUND

Band pass filters are used in a radio's frond end to let pass only wanted frequencies and block or otherwise attenuate frequencies above and below the pass band. A band pass filter in a base transceiver station (BTS) radio is generally made from cavity resonators that are coupled together. It is known for such a cavity resonator to exploit multiple modes (multiple resonant frequencies) in order to reduce the size of the filter. From a design perspective the highest Q per volume is desirable in order to achieve the most compact filter with the lowest insertion loss. The quality or Q factor is a figure of merit for reactive components such as capacitors and inductors that measures energy efficiency; specifically it is a ratio of stored energy to dissipated power per unit time. A resonant cavity is in effect a reactive component in which some external coupling/power source excites electromagnetic fields within the cavity, and it is known to use the Q factor as a design and performance metric for cavity resonators. Also desirable in a practical bandpass filter is flexibility in its operational parameters so the filter can perform a wide variety of filtering functions to optimally meet the specifications needed for a given deployment. What is needed in the art is a compact band pass filter with a very low insertion loss that also has great design flexibility.

In this regard two prior art filters are relevant:

The Black Hole Filter by the KMW company of Hwasung, Korea; see http://www.kmw.co.kr/eng/product/product_new_3.html, last visited Nov. 17, 2016) is made from a ceramic sphere loaded cavity operating with triple transverse-electric (TE) modes.

The Seven-pole UMTS filter by Radio Frequency Systems of Meriden, Conn., USA (see http://www.rfsworld.com/stayconnected/index.php?p=657&1=1&listName=stayconnected_en_articles&indexVal=67 last visited Nov. 17, 2016) is a ceramic filter with triple transverse-magnetic modes in a cubic format.

SUMMARY

According to a first aspect of these teachings there is a radio frequency (RF) filter comprising: an electrical conductor defining an outer sphere; a dielectric material defining an inner sphere disposed within the conductor outer sphere; and at least a first electrical probe and a second electrical probe, each said probe extending through the conductor and electrically insulated from said conductor. A spherical shape of one or both of the inner and outer spheres is interrupted by: a) a first localized discontinuity in said spherical shape disposed along a first axis passing through a geometric center of the one or both of the inner and outer spheres; and b) a second localized discontinuity in said sphere form disposed along a second axis passing through the geometric center, the second axis perpendicular to the first axis.

According to a second aspect of these teachings there is a radio frequency (RF) filter comprising: a sphere; an input probe defining an interior end and an opposed exterior end; and an output probe defining an interior end and an opposed exterior end. In this second aspect the sphere is characterized by three orthogonal transverse magnetic (TM) modes, a first localized discontinuity in said sphere along a first of the TM modes and a second localized discontinuity in said sphere along a second of the TM modes. The interior end of each probe is disposed within the sphere or within a resonant chamber air cavity about the sphere.

DETAILED DESCRIPTION

These teachings describe a frequency selective filter, for example a band pass filter used for filtering radio-frequency (RF) or intermediate-frequency (IF) energy waves, made from one or more electric probe coupled spheres. Each sphere supports three degenerate, orthogonal, fundamental, transverse magnetic (TM) modes. A TM mode within a sphere has the highest Q per volume compared to any other geometry. The black hole filter mentioned in the background section above operates with TE modes. This filter's TE modes require a larger volume and have reduced Q compared to the spherical TM modes of the filters described herein. The seven-pole UMTS filter mentioned in the background section above operates with TM modes and is explicitly a cubic shape.

The embodiment of the frequency selective filter illustrated herein has a ceramic or other dielectric in the shape of a sphere, but as will be detailed further below it is not a true sphere in that there are perturbations in the spherical shape that operate to split the resonant frequencies of each mode such that they span the filter band. These perturbations are illustrated herein as chamfers or bevels since these are the most visual form but these perturbations may be manifest by other means such as tuning screws, bulges that expand the spherical shape in localized regions, localized depressions or concavities that bow towards the center of the otherwise spherical shape, and so forth. Each such perturbation may be considered a localized discontinuity in the spherical form of the resonant cavity. In this regard localized means each discontinuity in the spherical shape of the resonant cavity is non-contiguous with each other discontinuity, so for example no two chamfers/bevels intersect with one another.

Figure 1:
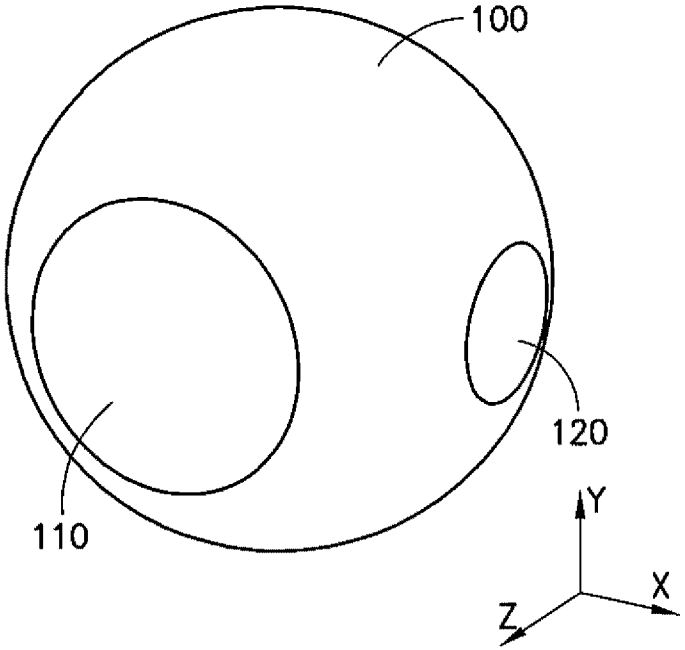
FIG. 1 is a perspective view of a chamfered silver plated dielectric sphere according to a non-limiting embodiment of these teachings.

FIG. 1 is a perspective view of a chamfered silver plated dielectric (ceramic) sphere 100 according to a non-limiting embodiment of these teachings. The silver or other conductive plating is a coating and so the interior surface of the conductor matches the exterior surface of the ceramic sphere. In FIG. 1 what is visible is the conductor and so the conductor may be considered an outer sphere and the ceramic/dielectric material is an inner sphere disposed within the conductor outer sphere. In this embodiment the spherical shape of both the silver coating and the ceramic sphere 100 is interrupted by a first discontinuity 110 illustrated as the larger diameter chamfer. If we assume the origin of the Cartesian coordinate system shown at FIG. 1 is coincident with the geometric center of the resonant cavity within the shell 100, this first discontinuity/large diameter chamfer 110 is disposed along the Z-axis or more generally along a first axis. The sphere shape is also interrupted by a second discontinuity 120 illustrated as the smaller diameter chamfer, which is disposed along the X-axis (second axis) that is perpendicular to the Z-axis since the coordinate system is Cartesian.

The perspective view of FIG. 1 does not afford illustrating that in a preferred embodiment there are two instances of each of these first 110 and second 120 discontinuities to the spherical shape of the resonant cavity. Each discontinuity pair lies along the same axis at opposed sides of the resonant cavity, so along the Z-axis on the right-rear side of the FIG. 1 shell 100 there is another instance of the larger diameter chamfer 110 and along the Y-axis on the left-rear side of the FIG. 1 shell 100 there is another instance of the smaller diameter chamfer 120. In some embodiments the paired discontinuities need not be identical. In this preferred embodiment the silver plated dielectric sphere 100 is also characterized by a lack of any discontinuities to the spherical shape along the Y-axis, which is the third axis of the system. Since the Cartesian axes may be arbitrarily rotated so long as their mutual perpendicularity is maintained, this means the only discontinuities in the spherical shape of the resonant cavity are those that lie along two perpendicular axes.

The chamfers 110, 120 shown at FIG. 1 lock the TM modes into the X, Y and Z directions, as these chamfers are each centered along only the Z or X axis. As mentioned above in a preferred embodiment the Y direction does not have a chamfer; it is not needed because complete control over the three mode frequencies is achieved with three variables—two chamfer sizes (larger diameter for chamfer 110, smaller diameter for chamfer 120) and the sphere 100 diameter. In FIG. 1 the lowest frequency mode is in the Z direction, the middle frequency mode is in the X direction and the highest frequency mode is in the Y direction. As the chamfer size increases, the two modes that are parallel to the chamfer face go higher in frequency, without changing the frequency of the mode that is perpendicular to the chamfer face. Thus the largest chamfer along the Z-axis raises the frequency in the Y and X directions but not the Z direction, while the smaller chamfer along the X-axis further raises the frequency in the Y direction as well as the Z-direction so the Y direction is the direction of highest frequency.

Each sphere 100 supports three degenerate orthogonal fundamental TM modes. The perturbations or discontinuities 110, 120 in the spherical shape split the frequencies of the different TM modes, and these discontinuities 110, 120 are designed to split the frequencies so as to span the filter band. As mentioned above, the localized discontinuity may be implemented as a tuning screw, chamfer in the ceramic, chamfer in the air cavity wall, removal of ceramic, additional space in the air cavity wall, and so forth. At the present time the preferred implementation for implementing the frequency splitting perturbations/discontinuities is with chamfers in the ceramic as shown in FIG. 1. This allows the highest Q as it has the least disruption to the current path, while also allowing a large frequency splitting for a wide range of filter bandwidths.

Figure 3B:
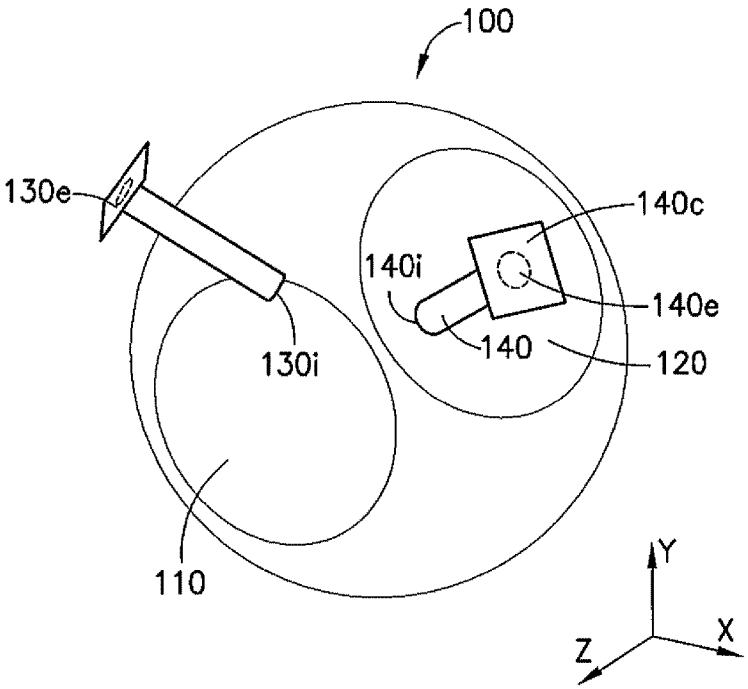
FIG. 3*a* is a perspective view of a PNP embodiments of chamfered silver plated dielectric sphere, and FIG. 3*b* similarly illustrates another PNP embodiment in transparent view to illustrate the probe depths.
Figure 3A:
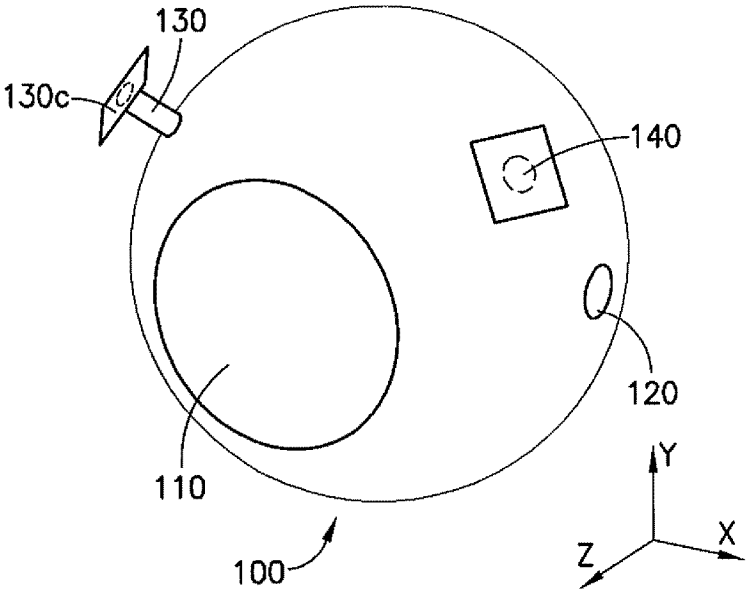

FIG. 3*a* illustrates similar as FIG. 1 but further shows two electric probes 130, 140 that couple energy into and out of the sphere 100. The first probe 130 may be considered an input probe and the second probe 140 may be considered an output probe. As can be seen in the transparent view of FIG. 3*b*, each of the first 130 and second 140 probes extend through the conductive coating and into the ceramic sphere 100, and each has an interior end 130*i*, 140*i* that lies within the ceramic and an opposed exterior end 130*e*, 140*e* that lies outside the conductive plating.

Each probe 130, 140 is electrically isolated from the grounded cavity walls. For a silver plated ceramic as in FIG. 1, each probe 130, 140 could be implemented as a silver-plated blind-depth hole drilled into the ceramic, where a small iris around the top of the hole isolates the probe 130, 140 from the silver plated walls of the sphere 100 which are grounded.

Figure 9A:
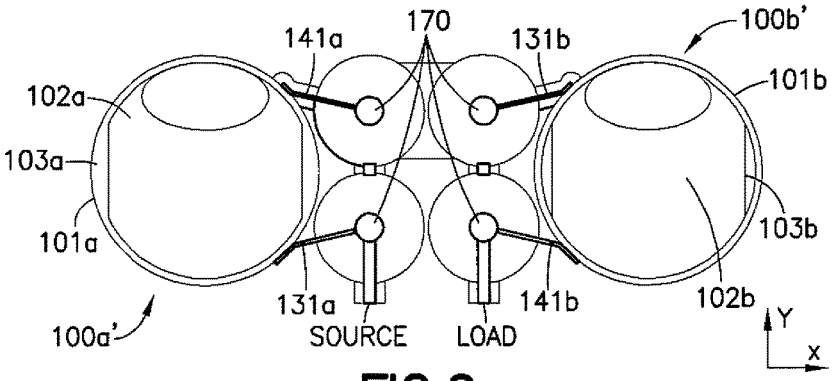
FIGS. 9*a-b* illustrate, in plan view and side view respectively, two spheres cascaded in series with four air coaxial quarter-wave resonators, according to an example embodiment.
Figure 9B:
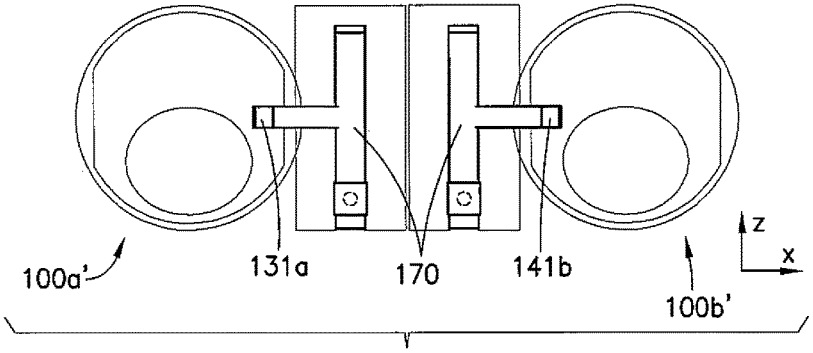

In a second embodiment the ceramic sphere can be as shown in FIG. 1 but in this case it is suspended within an air cavity defined by an outer conductive sphere so there is an air gap between the outer conductive shell and the internally suspended ceramic sphere. FIGS. 9*a-b* illustrate this second embodiment with two of them cascaded in series. The external shape of the conductor is non-functional in this embodiment, only the spherical shape of the interior surface of the conductive shell is relevant to the frequency filtering. For a ceramic inner sphere suspended within a conductive outer sphere and an air gap between them, the probes 130, 140 could be implemented as an open ended metallic pin inserted some distance into the air gap between the suspended ceramic sphere and the conductive cavity walls of the outer shell. In this case the pin could have a cap 130*c*, 140*c* at the exterior end 130*e*, 140*e* as shown at FIG. 3 to increase the amount of energy entering each sphere, thereby enabling a filter with increased bandwidth. There may also be a probe wire contacting the suspended ceramic sphere or inserted into the suspended ceramic sphere some distance to allow increased bandwidth. The frequency filtering principle works the same as described above for the silver plated ceramic sphere.

For the second embodiment described above the conductive shell has an interior surface that is spherical (no discontinuities) and the discontinuities to any spherical shape lie within the ceramic sphere. In a first variation of that second embodiment these aspects can be reversed so that the ceramic is implemented as a true sphere and the discontinuities to the spherical shape are manifested on the interior surface of the conductive shell in which the ceramic is suspended. In a second variation there are discontinuities in both the ceramic sphere and the spherical interior walls of the conductor that form the shell. In a third embodiment there is no coated or suspended ceramic sphere at all but only the spherical interior surface defining an air cavity and whose spherical shape is interrupted by discontinuities as detailed above. For example, this third embodiments may include a metal or other conductive shell with a plan view similar to that shown at FIG. 1 and defining the interior cavity (preferably silver coated), or this embodiment can be made of a hollow dielectric with a silver plating defining the interior air cavity. A hollow ceramic ball may be functional for this third embodiment but without a conductive coating about the ball or lining the interior cavity the modes would not be fully contained. Some non-limiting examples of the specific form these discontinuities to the spherical shape may take are described above, and these are also valid for the second embodiment, its variations, and the third embodiment.

By changing the position at which each probe sits on the sphere surface, a completely generalized frequency response can be achieved as will be detailed further below. As a consequence of this flexibility in the pole and zero placement, the band pass filter can form any filtering function so as to optimally meet a filter specification. As an example, the probe locations at FIG. 3*a* are different from those at FIG. 3*b*.

The embodiments illustrated herein have discontinuities of the spherical shape along two of the three Cartesian axes, and the probes located off-axis to achieve the desired frequency response. Mathematically this is the simplest to model so that an engineer can design a given embodiment for a specific bandpass requirement. But in principle there can be one or more of the discontinuities off axis. Designing such an embodiment for a specific pre-defined bandpass requirement is more complex mathematically, particularly if there are more than a few off-axis discontinuities, but the operating principle would be the same as the embodiments that are specifically illustrated herein.

While FIGS. 1 and 3*a*-3*b* illustrate a single sphere 100, in some embodiments two or more spheres 100 can be cascaded by connecting the output probe of the first sphere to the input probe of the second sphere, as will be shown in detail at FIGS. 6-10 and related explanation. Alternatively, two or more spheres 100 can be connected in parallel, thereby eliminating the sphere to sphere interconnect. Such parallel connection of spheres is detailed below with respect to FIGS. 11-14. To the inventors' knowledge such parallel connection of resonant cavities to form a band pass filter is largely unknown in the radio arts. But coupling resonators within a triple mode structure only in series limits the design flexibility because filtering functions with flexible transmission zeros require complicated coupling structures. The example illustrations herein of the filtering spheres were designed by assuming the three modes within the sphere are coupled in parallel, which enables flexible transmission zero control with simple physical interconnect structures.

In the theory of parallel coupled resonators, the ratio of coupling amplitude into/out of each resonator via the two probes 130, 140, along with the relative phase of these couplings, dictate the filter pole and zero placement. Two spheres coupled in parallel with both electric probes allows all possible ratios of coupling amplitudes and phases, thereby allowing a generic filtering function with the arbitrary placement of three poles and two zeros. A third transmission zero is also generated by the probe-to-probe coupling shown herein, but the exact placement control is limited, however choosing which side of the pass band it sits is possible, as will be shown below.

Figure 2:
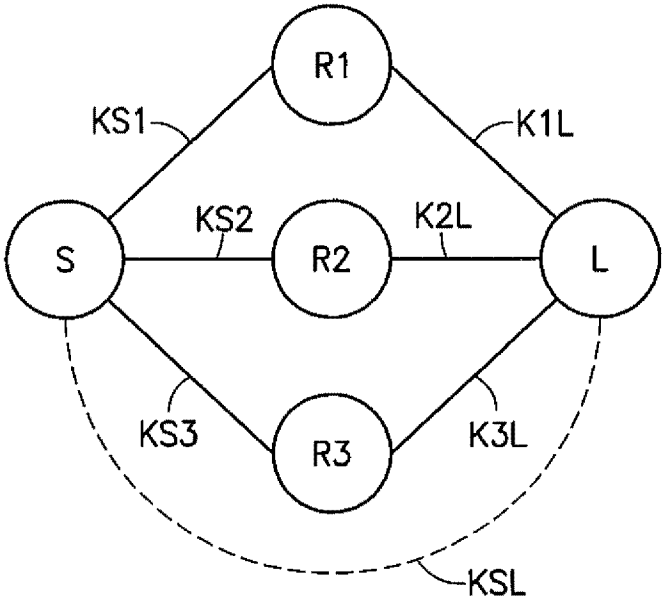
FIG. 2 is an electrical diagram that models the frequency response of an embodiment such as FIG. 1 with parallel coupled modes.

FIG. 2 is an electrical diagram that models the frequency response of an embodiment of a single sphere such as FIG. 1 with parallel coupled modes. In this diagram, S represents the source or input probe, L represents the load or output probe, R1, R2 and R3 are the mode frequencies, and all the K parameters represent the coupling frequencies between the Source/Load and the sphere modes. The modes R1 to R3 can arbitrarily represent any mode, but for convenience of explanation assume R1 represents the lowest frequency mode (which is the mode in the Z direction of FIG. 1). R2 represents the middle frequency mode (the mode in the X direction of FIGS. 1), and R3 represents the highest frequency mode (the Y direction of FIG. 1).

The angle at which each probe 130, 140 points while sitting on the surface of each sphere 100 defines the ratio of coupling into each mode. That is, the modes are orthogonal with the electric field of each mode pointing in either the X, Y or Z directions of space. The amount of coupling into each mode is dictated by the degree to which the probe 130, 140 points in the direction of each mode. For instance, an input or source probe 130 pointing purely in the X direction will only couple to the X mode, making the FIG. 2 values for KS1 and KS3 zero, and KS2 non-zero. If the probe is rotated 45 degrees around the Z direction in the XY plane, it will couple to the X and Y mode equally but will not couple to the Z mode. If the probe is then rotated 45 degrees in the direction perpendicular to the XY plane, it will couple to all modes equally. This latter rotation is what is shown at FIG. 3*a* for both probes 130, 140.

The phase of the coupling into and out of each mode is defined by the relative spherical octant each probe sits within. That is, when the three modes are in the X, Y and Z directions, the sphere can be broken up into eight Cartesian regions or four quadrants in two distinct hemispheres. If the two ports/probes 130, 140 sit in the same octant, each port will see the same phase (or direction) of the electric field, so the input/output (IO) coupling into each mode will be in-phase meaning the multiplication of the input and output coupling will be a positive number. If the two ports sit in one of the three adjacent octants, two of the mode IO couplings will be in-phase while one of the mode IO couplings will be out-of-phase meaning the multiplication of the input and output couplings will be a negative number. If the two ports sit in one of the three diagonally adjacent octants as in FIG. 3*a*, one of the mode IO couplings will be in-phase while two of the mode IO couplings will be out-of-phase. If the two ports sit in opposite octants, all three mode IO couplings will be out-of-phase.

To achieve a passband filter response, the modes of the sphere should span the band of interest with adjacent modes having opposite phases. That is, if the low mode (R1) is in-phase, the middle mode (R2) must be out-of-phase such that they support each other at the frequencies between them and cancel each other at all other frequencies, and the high mode (R3) must be in-phase. Hereinafter this is referred to as a PNP (positive, negative, positive, or in-phase, out-of-phase, in-phase) sphere. Alternatively, if the low mode is out-of-phase, the middle mode must be in-phase and the high mode must be out-of-phase. The reason for this is due to the phase flipping 180° at resonance—two modes that have opposite IO phasings will be in-phase and thus reinforce each other at the frequencies between them, and out-of-phase and thus cancelling and providing attenuation at all other frequencies. Hereinafter this is referred to as a NPN (negative, positive, negative, or out-of-phase, in-phase, out-of-phase) sphere.

PNP and NPN are not the only possible embodiments though. For example, there may be instances where all three modes having the same phase is beneficial. This creates transmission zeros between each mode and thus 'breaks up' the filter passband into multiple passbands that are not frequency-continuous with one another.

With the PNP and NPN explanation in mind, consider again FIGS. 3*a-b*. These illustrate PNP embodiments of the sphere, in which the sphere in FIG. 3*a* is opaque while the sphere in FIG. 3*b* is transparent in order to better illustrate the depth of the probes 130, 140.

Figure 4B:
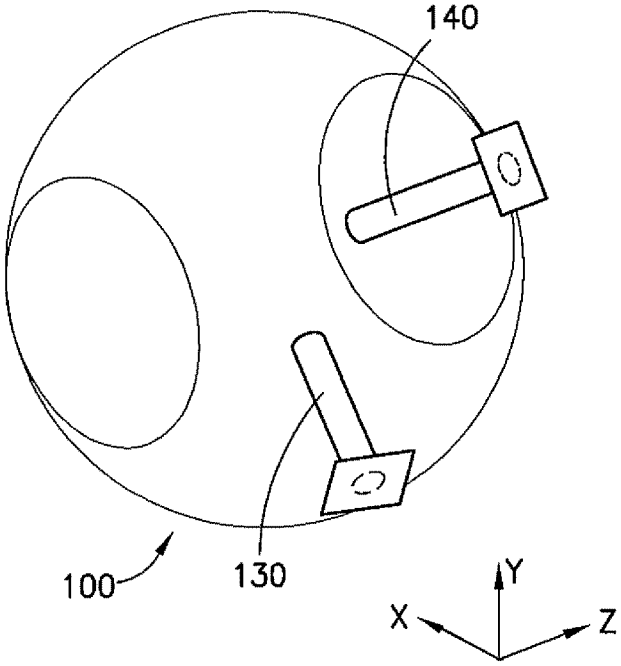
FIGS. 4*a-b* are similar to respective FIGS. 3*a-b* but these are NPN embodiments of the spheres.
Figure 4A:
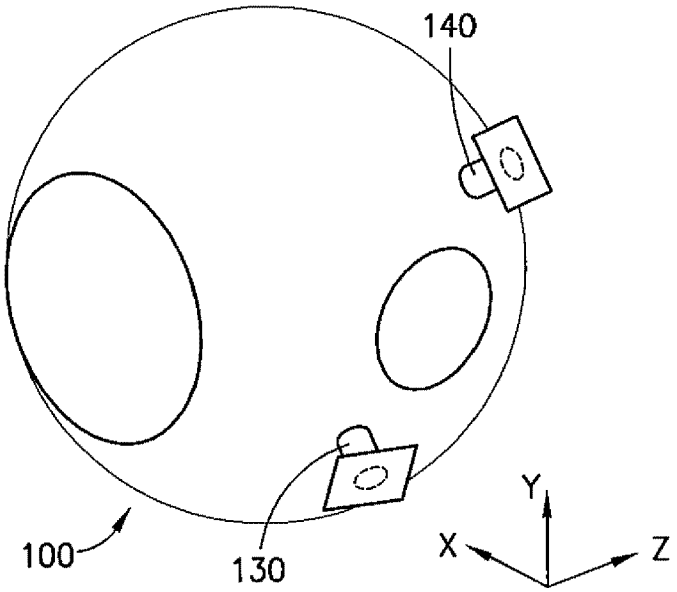

FIG. 4*a* is a view similar to FIG. 3*a* but the disposition of the probes 130, 140 make the FIG. 4*a* embodiment a NPN sphere. FIG. 4*b* is a transparent view similar to FIG. 3*b* but the disposition of the probes 130, 140 make the FIG. 4*b* embodiment also a NPN sphere.

Figure 5B:
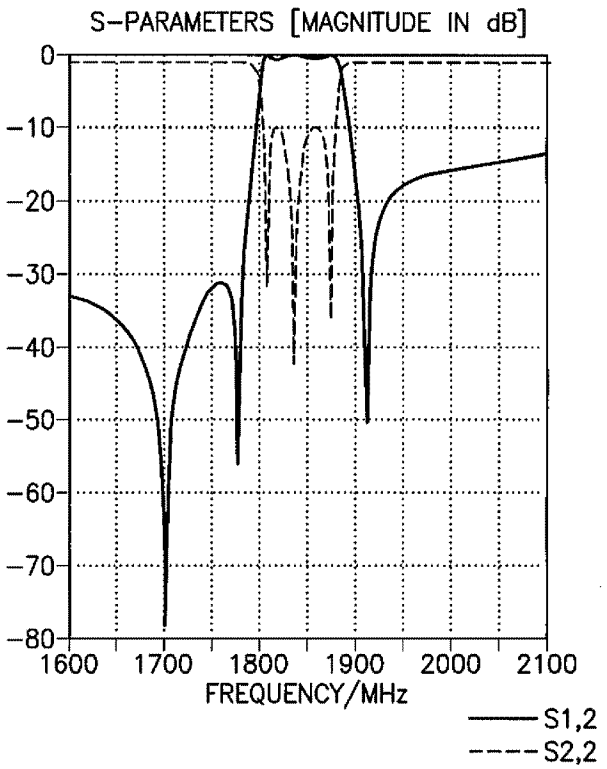
FIG. 5*a-b* are data plots showing the respective frequency response of the PNP sphere of FIG. 3*a* and the NPN sphere of FIG. 4*a*.
Figure 5A:
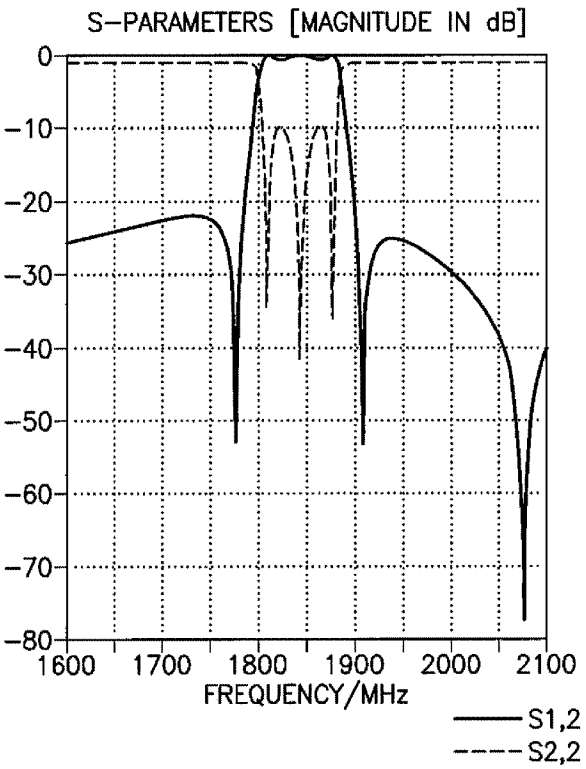

The frequency response of the PNP sphere of FIG. 3*a* is plotted at FIG. 5*a*, and that of the NPN sphere is plotted at FIG. 5*b*. In both cases the X mode is the middle frequency mode. For the PNP sphere plotted at FIG. 5*a* the input sees the opposite phase to the output; this is readily reflected in the PNP name where the middle N essentially means negative. For the NPN sphere plotted at FIG. 5*b*, the input sees the same phase as the output and so in the name the middle P essentially means positive. Both spheres plotted at FIGS. 5*a-b* have a port-to-port cross-coupling that defines a third transmission zero. In the PNP case the third zero sits on the high side of the passband (around 2075 MHz as plotted at FIG. 5*a*)) while in the NPN case the third zero sits on the low side of the passband (around 1700 MHz as plotted at FIG. 5*b*). The placement of this third zero can be controlled to a limited degree by changing the diameter of the probe hole. Therefore, the NPN sphere is generally more capable of generating increased attenuation on the low side of the passband as FIG. 5*b* illustrates, and so is more suited to be a transmit filter in many cellular systems. Similarly, the PNP sphere is generally more capable of generating increased attenuation on the high side of the passband as FIG. 5*a* illustrates, and so is more suited to be a receive filter in those cellular systems.

The placement of the two zeros closest to the passband can be easily modified by altering the coupling amplitudes; this occurs by moving the probes. For example, if the probes rotate such that they are more aligned with the X direction, the X mode coupling will increase while the other couplings will decrease. This will make the cancellation frequency (transmission zero) of the modes closer to the passband, giving a faster filtering roll-off. Similarly, if the probes rotate such that they are more aligned with the Z direction, the Z mode coupling will increase while the other couplings will decrease. This will make the transmission zero on the low side move further away from the passband, decreasing the low frequency side roll-off while the high frequency side transmission zero will move closer to the passband, increasing the high frequency side roll-off.

FIGS. 6-9*b* illustrate various non-limiting examples for coupling two spheres in series to form the passband filter, and these embodiments can be extended or even combined for series combinations of more than two. In the FIG. 6 example two spheres are cascaded by connecting the output of the first sphere 100*a* to the input of the second sphere 100*b*, creating a high frequency half wavelength transmission line interconnect 150. In this case there is an input probe 130*a* of the first sphere 100*a* that is the input probe to the entire series circuit, and an output probe 140*b* of the second sphere 100*b* that is the output probe to the entire series circuit. The output probe of the first sphere 100*a* and the input probe of the second sphere 100*b* form a single direct interconnect 150, which in this embodiment is high frequency and half wavelength.

Figure 7:
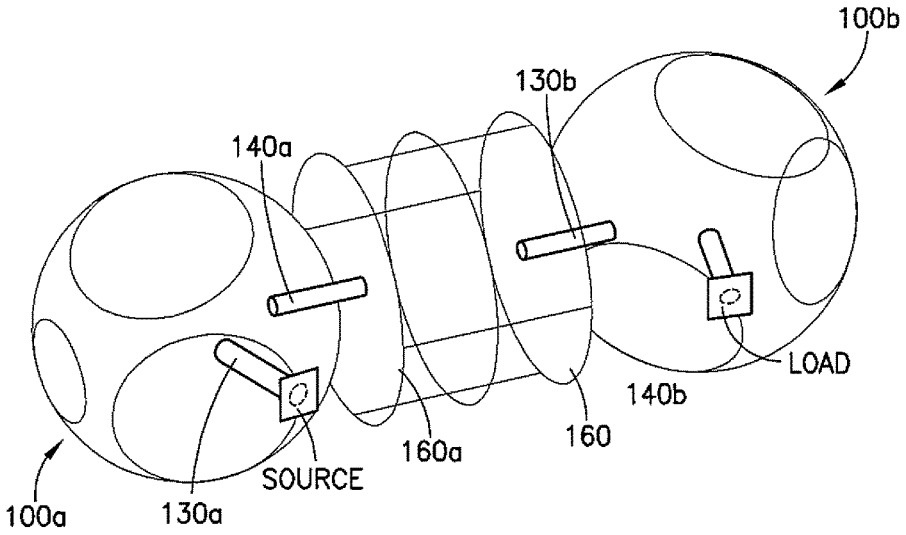
FIG. 7 is a perspective transparent view of two spheres connected in series by one or more (two as illustrated) single mode ceramic slab resonators according to an example embodiment.

FIG. 7 illustrates two spheres 100*a*, 100*b* connected in series with one or more (two as illustrated) single mode TM silver plated ceramic slab resonators 160*a*, 160*b* interfacing the output probe 140*a* of the first sphere 100*a* with the input probe 130*b* of the second sphere 100*b*. This interface is also half wavelength.

Figure 6:
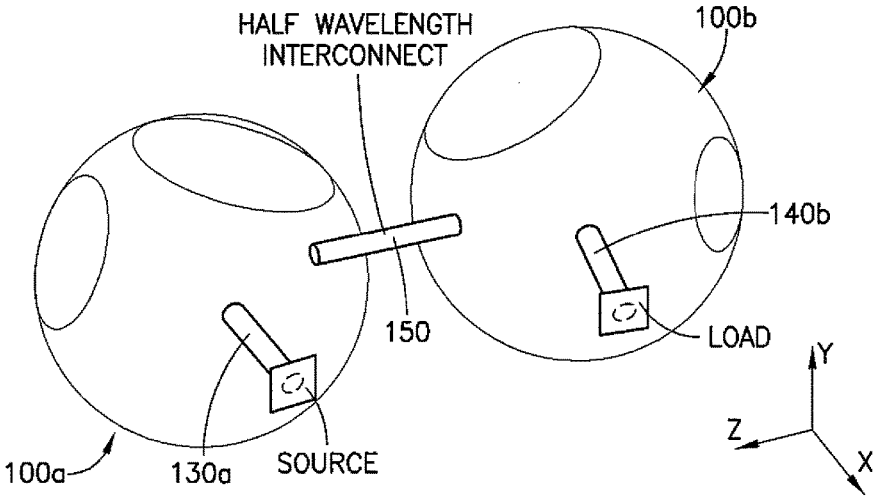
FIG. 6 is a perspective transparent view of two spheres connected in series by a high frequency half wavelength transmission line interconnect according to an example embodiment.
Figure 8:
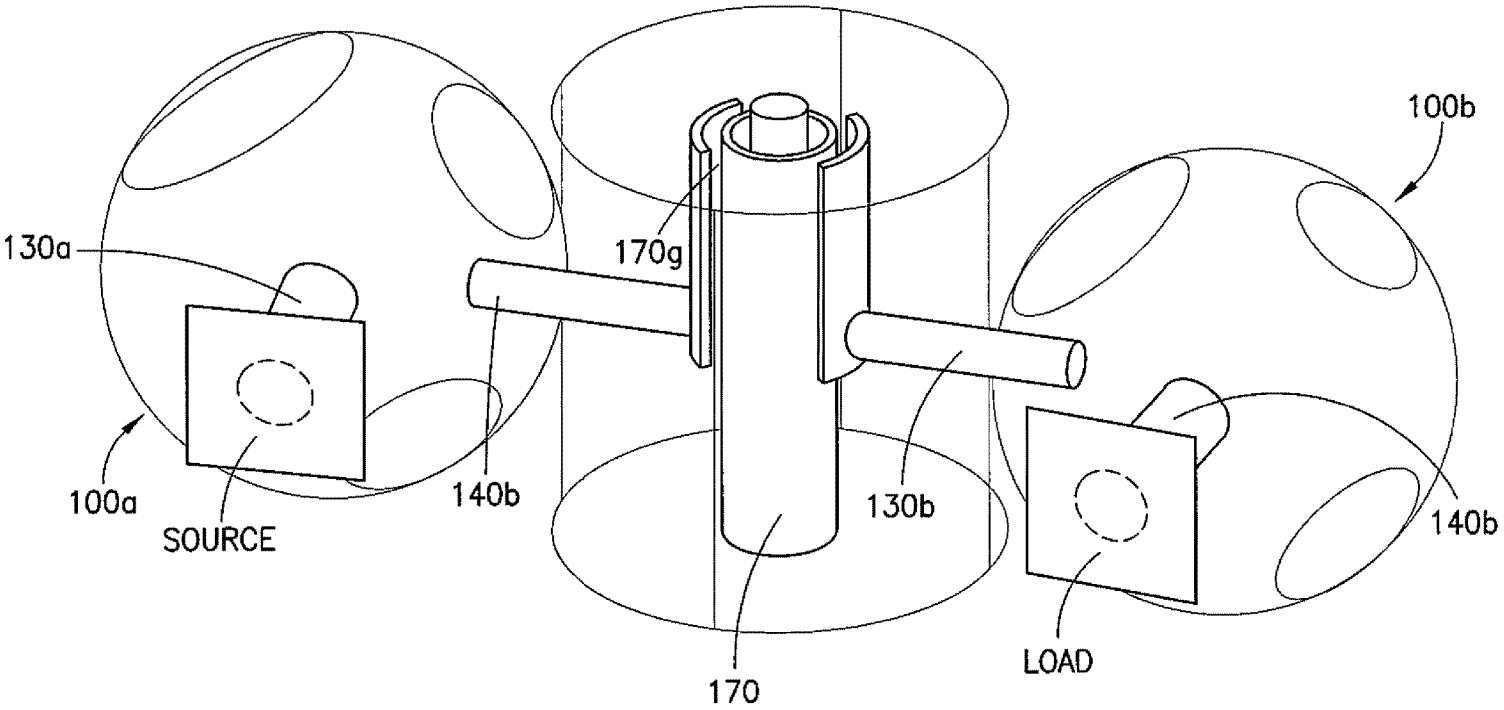
FIG. 8 is a perspective transparent view of two spheres connected in series by an air coaxial resonator according to an example embodiment.

FIG. 8 illustrates two spheres 100*a*, 100*b* connected in series with one or more (one illustrated) single mode air coaxial resonator 170 between each sphere, and like FIGS. 6-7 this is also a half wavelength interconnect. There is an insulating gap 170*g* on each side of the air coaxial resonator 170 to electrically couple to the centrally-disposed air coaxial resonator.

FIGS. 9*a-b* illustrates the second embodiment in which there is a conductor defining an outer sphere 101*a*, 101*b* and the ceramic defines an inner sphere 102*a*, 102*b* disposed within the conductor outer sphere and there is an air gap or cavity 103*a*, 103*b* between them. FIG. 9*a* is a plan view and FIG. 9*b* is a side view. Together the outer sphere, inner sphere and air gap/cavity may be considered to implement any of the other spheres 100*a*, 100*b* described herein that are connected in series or parallel. In FIGS. 9*a-b* the chamfers are defined on the ceramic but as noted above in another variation the chamfers or other discontinuities to the spherical shape can be implemented on the conductor outer sphere. These two ceramic sphere loaded air cavities 100*a*', 100*b*' are cascaded in series with four quarter wave air coaxial resonators 170. One quarter wave resonator 170 sits either side of each sphere 100*a*', 100*b*'. In FIGS. 9*a-b* the connection from each quarter wave air coaxial resonator 170 to the sphere is with a stub 131*a*, 141*a*, 131*b*, 141*b* grounded to the central coaxial conductor 102*a*, 102*b*.

In all these examples of series connections of spheres, the inter-sphere ordering of the coupling phases does not matter in the resulting output. That is, a NPN sphere can be cascaded with a PNP sphere or with a NPN sphere. Similarly, a PNP sphere can be cascaded with a NPN sphere or with a PNP sphere.

Figure 10:
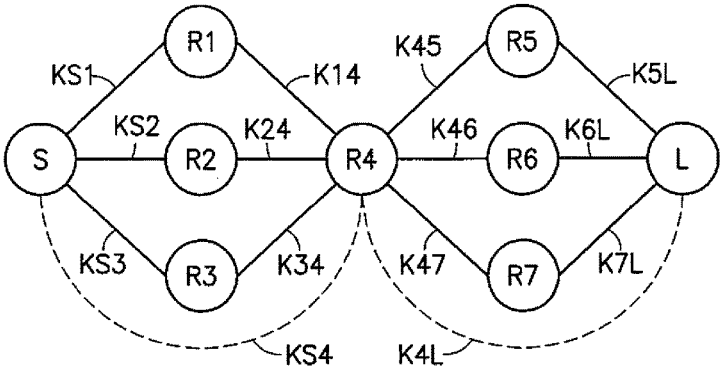
FIG. 10 is an electrical diagram that models the frequency response of an embodiment of two spheres that are cascaded in series such as the examples at FIGS. 6 and 8.

FIG. 10 is an electrical diagram that models the frequency response of two series cascaded spheres such as those illustrated at FIGS. 6 and 8. It does not properly reflect the FIG. 7 embodiment since that embodiment has two resonators between each sphere whereas FIG. 10 only models one.

Similarly, FIG. 10 does not fully model the FIG. 9*a-b* embodiment because a proper model for that embodiment would have two resonators between each sphere as well as one extra resonator after the source and one before the load.

The nomenclature used at FIG. 10 is similar to that of FIG. 2: S represents the source or input probe; L represents the load or output probe; R1, R2 and R3 are the mode frequencies of the first sphere 100*a*; R5, R6 and R7 are the mode frequencies of the second sphere 100*b*; R4 represents the interconnecting resonator (150 for FIGS. 6 and 170 for FIG. 8); and all the K parameters represent the coupling frequencies between the Source/Load/sphere modes that are indicated so for example KS2 is the parameter for coupling between the source and mode R2 while K46 is the parameter for the coupling between the interconnecting resonator R4 and mode R6. Note in for the embodiment of FIG. 6, R4 in FIG. 10 represents the half-wavelength interconnect 150 which is resonating at a frequency much higher than the passband; for the embodiment of FIG. 8, R4 in FIG. 10 represents the air coaxial quarter wave resonator 170 which is resonating in band.

Figure 11:
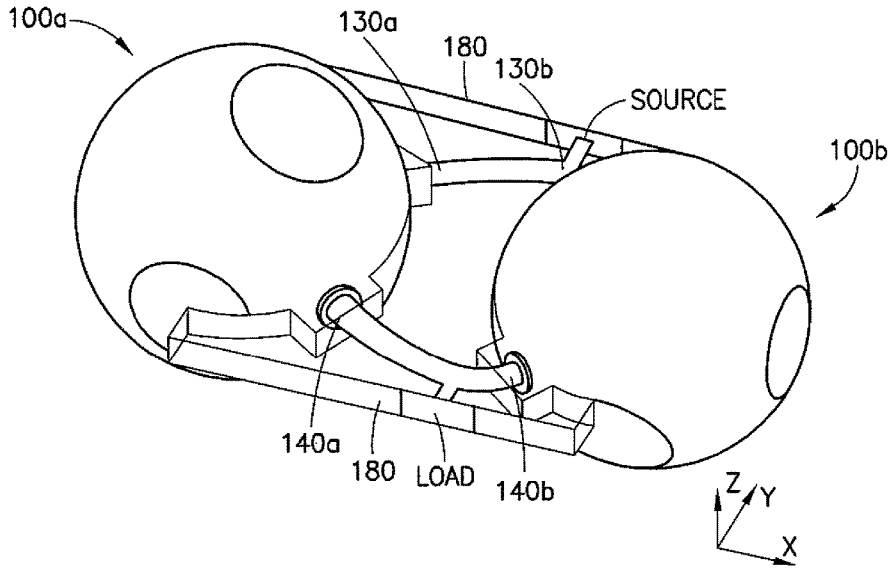
FIG. 11 is a perspective view of two spheres connected in parallel by two half-wavelength stripline transmission line resonators according to an example embodiment.
Figure 12:
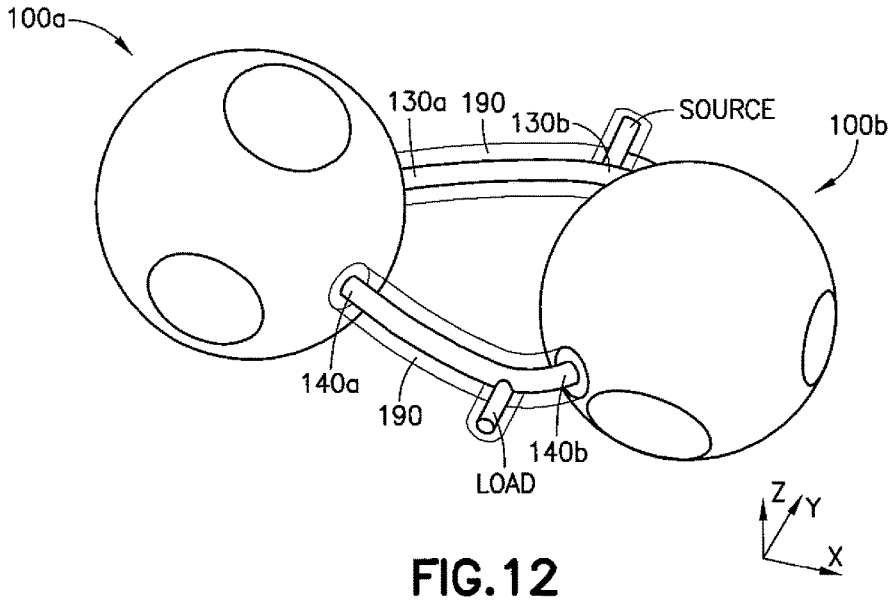
FIG. 12 is a perspective view of two spheres connected in parallel by two half-wavelength coaxial transmission line resonators according to an example embodiment.
Figure 13:
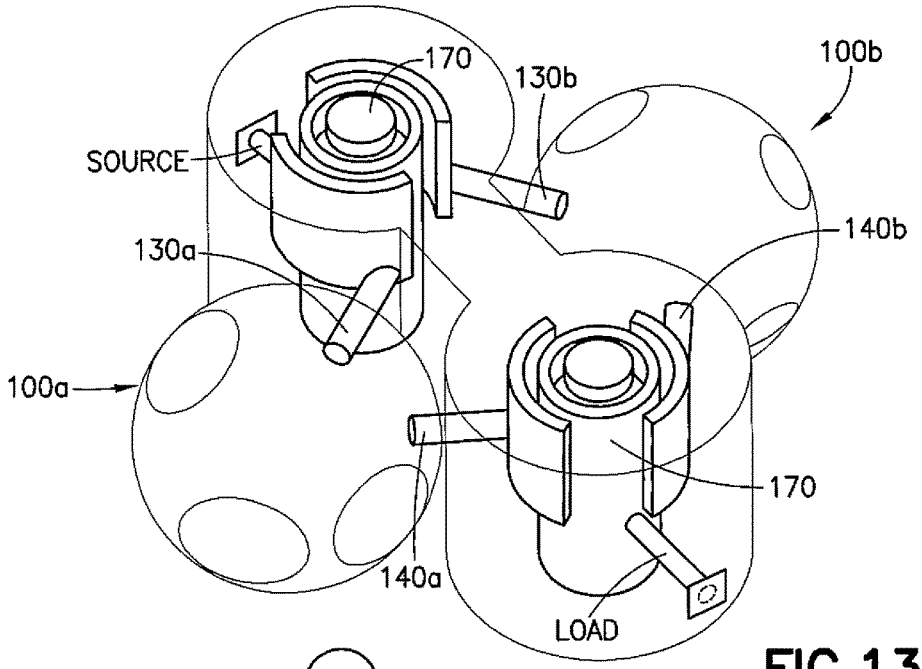
FIG. 13 is a perspective transparent view of two spheres connected in parallel by two air coaxial quarter-wave resonators according to an example embodiment.

FIGS. 11-13 illustrate various non-limiting examples for coupling two spheres in parallel to form the passband filter, and these embodiments can be extended or even combined for parallel combinations of more than two. There are two half wavelength transmission-line resonators implemented as striplines 180 in FIG. 11 and as coaxial cables 190 in FIG. 12. FIG. 13 employs two quarter wavelength air coaxial resonators 170. In each of FIGS. 11-13 these act as input and output in-band resonators that couple energy into each mode of each sphere in parallel. The lowest three frequencies of the filter are generated by the slightly larger sphere 100*a* while the highest three frequencies are generated by the slightly smaller sphere 100*b*.

For parallel-coupled spheres the inter-sphere ordering of the coupling phases become important. In order to get a coherent passband without transmission zeros inside the passband, the modes need to alternate as the frequency increases; PNPNPN or NPNPNP. Therefore, a PNP sphere needs to be parallel coupled with a NPN sphere to get a passband filter response. In FIGS. 11-13, the first sphere 100*a* is PNP and has a relatively larger diameter, while the second sphere 100*b* is NPN and has a relatively smaller diameter. The diameter of a given sphere can be taken under the assumption that there are no perturbations/discontinuities to the true spherical shape.

Figure 14:
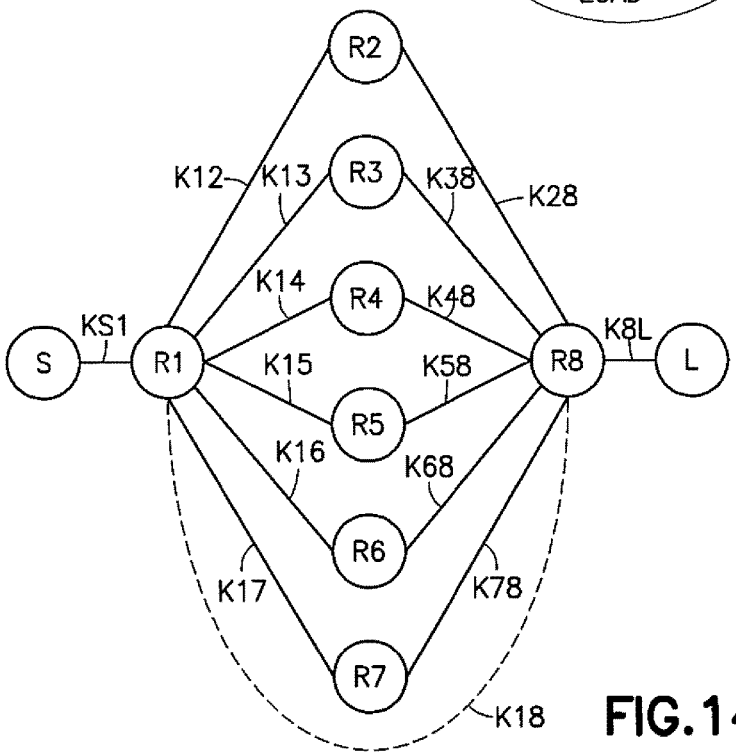
FIG. 14 is an electrical diagram that models the frequency response of an embodiment of two spheres that are connected in parallel.

Similar to the models at FIGS. 2 and 10, FIG. 14 is an electrical diagram that models the frequency response of parallel coupled spheres such as those shown at FIGS. 11-13. Nomenclature for FIG. 14 follows that of FIGS. 2 and 10, except for FIGS. 14 R2, R3 and R4 are the mode frequencies of the first sphere 100*a*; R5, R6 and R7 are the mode frequencies of the second sphere 100*b*; and R1 and R8 represent the respective input and output in-band interconnecting resonators (180, 190 and 170 in respective FIGS. 11-13).

Figure 15A:
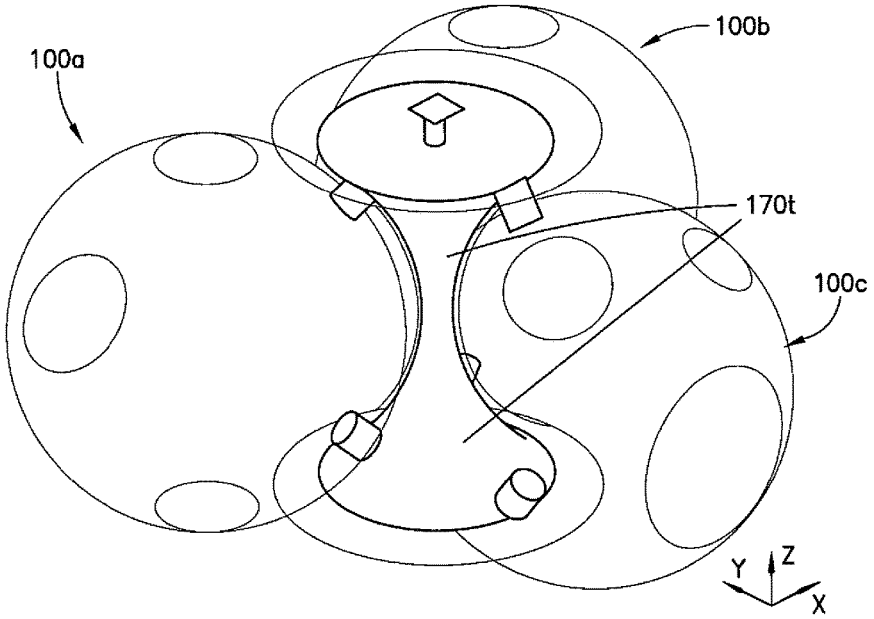
FIGS. 15*a-c* are perspective, plan and top views respectively of an embodiment in which three spheres are connected in electrical parallel.
Figure 15B:
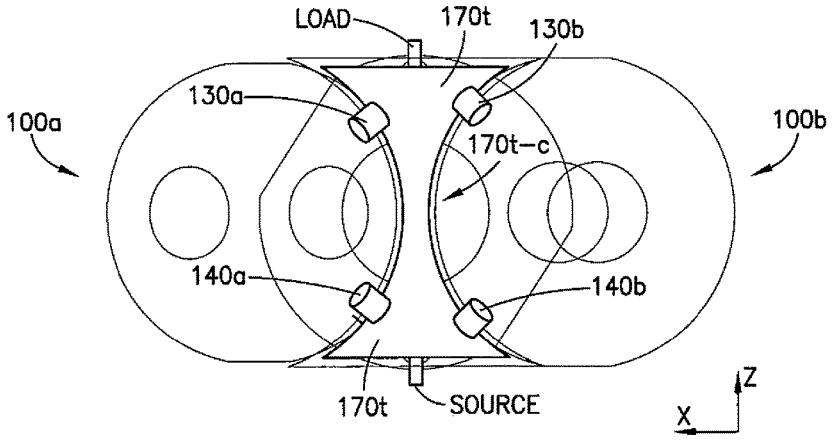
Figure 15C:
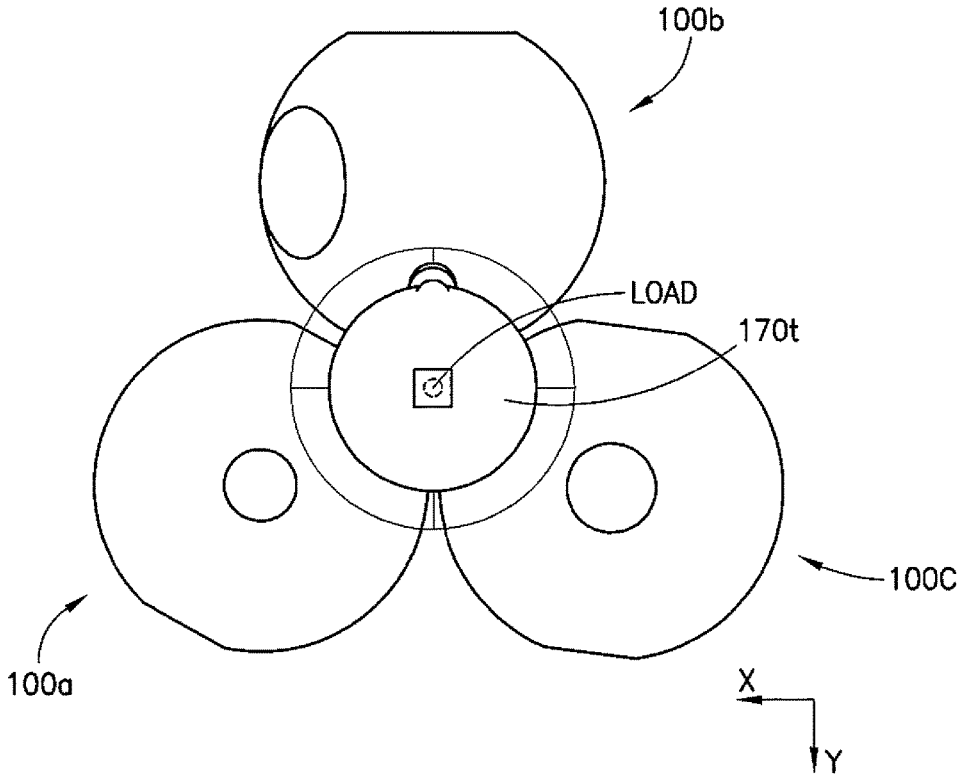

More than two spheres can be coupled in electrical parallel as shown by example at FIGS. 15*a-c* for three spheres. FIG. 15*a* is a perspective view with transparent spheres 100*a*, 100*b*, 100*c*, FIG. 15*b* is a plan also with transparent spheres, and FIG. 15*c* is a top view with non-transparent spheres all of the same embodiment. In this example the parallel coupling is via two air coaxial quarter wave resonators 170*t* that as depicted are disposed as vertical mirror images of one another, and the source and load for the assembly is best shown at FIG. 15*b* with the source defined by one of the resonators 170*t* and the load defined by the other. Notably there is a coupling 170*t-c* between grounded ends of the quarter wave resonators 170*t*, also best shown at FIG. 15*b*. Input probes 130*a*, 130*b* and output probes 140*a*, 140*b* are shown for two of the spheres 100*a*, 100*b*, and are similar for the third sphere 100*c*. Preferably each sphere 100*a*, 100*b*, 100*c* defines a different diameter but in more specific deployments they may all define the same diameter or they may define two different diameters among the three spheres 100*a*, 100*b*, 100*e*. As with the other parallel-coupled embodiments it is preferable that the phases of the coupled spheres alternate, so for example the phases, of the nine parallel modes for three spheres coupled in parallel can ascend in frequency with the order PNPNPNPNP. The lowest three frequencies are generated by the PNP sphere 100*c*, the middle three frequencies are generated by the NPN sphere 100*b* while the highest three frequencies are generated by the PNP sphere 100*a*. Three parallel spheres could also be coupled with NPNPNPNPN phase ordering.

In view of the above more detailed description and examples, a radio frequency (RF) filter according to these teachings can be described in physical terms as an electrical conductor defining an outer sphere such as the silver coating at FIG. 1 or the conductive shell 102*a* at FIG. 9*a*; a dielectric material defining an inner sphere disposed within the conductor outer sphere such as the ceramic within the coating at FIG. 1 or the ceramic ball/inner sphere 101*a* at FIG. 9; and at least a first electrical probe 130 and a second electrical probe 140, each said probe extending through the conductor and electrically insulated from said conductor. In this case the spherical shape of one or both of the inner and outer spheres is interrupted by: a first localized discontinuity in said spherical shape such as the larger diameter chamfer 110 at FIG. 1 disposed along a first axis passing through a geometric center of the one or both of the inner and outer spheres; and it is also interrupted by a second localized discontinuity in said sphere form such as the smaller diameter chamfer 120 of FIG. 1 disposed along a second axis passing through the geometric center, the second axis perpendicular to the first axis.

In that these example chamfers have different diameters, the first localized discontinuity defines a more substantial disruption to the spherical shape than the second localized discontinuity. As shown at FIG. 1 and explained there for the Y-direction, the spherical shape is characterized by a lack of any localized discontinuity disposed along a third axis passing through the geometric center, where the third axis is mutually perpendicular to the first axis and to the second axis (the respective Z- and X-directions for the FIG. 1 example). While not evident from FIG. 1 it was explained that there can be mirror images of the visible chamfers on the opposite non-visible sides of the sphere 100, such that there would be two instances of the first localized discontinuity disposed along the first axis (Z-direction in FIG. 1) on opposed sides of the geometric center; and two instances of the second localized discontinuity are disposed along the second axis (X-direction in FIG. 1) on opposed sides of the geometric center. As above, this assumes one moves the center of the coordinate system to the geometric center of the sphere.

In the specific embodiment shown at FIG. 1 the electrical conductor is a conductive coating about the dielectric material and the spherical shape of both the inner (ceramic) and the outer (silver coating) spheres is interrupted by the first and the second discontinuities (chamfers 110, 120). For this embodiment, and in fact for any of them, the localized discontinuities can be implemented as one or more of the following (multiple instances of each or they may be mixed in a given embodiment): a) a chamfer in the inner and the outer spheres, b) an adjustable tuning screw passing through the outer sphere and into the inner sphere, c) a bulge in the inner and the outer spheres, and d) a depression in the inner and the outer spheres. For the FIG. 1 embodiment the electrical probes extend into the inner sphere ceramic which is filled with the dielectric material (e.g., the inner sphere is solid ceramic) as more particularly shown at FIGS. 3*a-b*.

In the specific embodiment shown at FIGS. 9*a-b* the electrical conductor defines a shell 101*a*, 101*b* within which the dielectric material 102*a*, 102*b* is suspended and separated therefrom by an air gap 103*a*, 103*b*. In this embodiment, the localized discontinuities may be implemented as at least one of: a) a chamfer, bulge or depression in the shell; b) a chamfer, bulge or depression in the dielectric material, and c) an adjustable tuning screw passing through the outer sphere and terminating within the air gap. Also in this embodiment each electrical probe 130, 140 defines an interior end 130*i*, 140*i* such as shown at FIGS. 3*a-b* but for this embodiment the interior ends terminate within the air gap 103*a*, 103*b*.

Various series-connected RF filter pairs were also detailed to form a passband filter, and one such embodiment had the output probe 140*a* of the first RF filter 100*a* and the input probe 130*b* of the second RF filter 100*b* form a half wavelength interconnect 150 between the first and second RF filters 100*a*, 100*b* as FIG. 6 illustrates. Other series connections are shown at FIGS. 7-8, where the output probe 140*a* of the first RF filter 100*a* is electrically connected to the input probe 130*b* of the second RF filter 100*b* via one or more: ceramic slab resonators 160*a*, 160*b* each having a conductive coating (FIG. 7); and one or more air coaxial resonators (FIG. 8).

Various parallel-connected RF filter pairs were detailed at FIGS. 11-13 to form a passband filter, and for all of these it is advantageous that the two filter have different diameters, so for example the inner (ceramic) sphere of the first RF filter 100*a* defines a first diameter that is larger than a second diameter defined by the inner sphere of the second RF filter 100*b*. For parallel connecting it is also advantageous that the two filters are coupled such that phases of the modes alternate NPNPNP or PNPNPN as detailed above. In this case each RF filter is characterized by three transverse magnetic TM modes. In the FIG. 11 embodiment the two RF filters 100*a*, 100*b* were connected in parallel via two half-wavelength transmission line resonators 180, and in the FIG. 12 embodiment they were electrically connected in parallel via two air coaxial resonators 190. In the embodiment of FIGS. 15*a-c* there are three spheres coupled in electrical parallel via a pair of stacked quarter wave air coaxial resonators.

The RF filters described herein can also be defined in terms of their electrical characteristics. In this regard, more generally such an RF filter comprises a sphere; an input probe defining an interior end and an opposed exterior end; and an output probe defining an interior end and an opposed exterior end. In particular the sphere 100 is characterized by three orthogonal transverse magnetic (TM) modes, a first localized discontinuity such as the chamfer 110 in said sphere 100 along a first of the TM modes and a second localized discontinuity such as the other chamfer 120 in said sphere along a second of the TM modes. In this characterization there may or may not be a conductive coating or air gap as mentioned above. The interior end of each of the two probes is disposed within the sphere (regardless of whether it is solid or hollow to define an interior air cavity resonant chamber) or within a resonant chamber air cavity about the sphere.

In a particular embodiment such a sphere 100 is characterized in that the first and second localized discontinuities in said sphere split resonant frequencies along the respective first and second TM modes so as to span a designated frequency band that passes through the RF filter. In FIG. 1 these modes are along the X- and Z-directions.

In another particular embodiment the input probe 130 and the output probe 140 are disposed about the sphere 100 such that an electrical field applied across them yields either a PNP filter in which there is in-phase coupling of two of the three TM modes and out-of-phase coupling of the remaining TM mode; or a NPN filter in which there is in-phase coupling of one of the three TM modes and out-of-phase coupling of the remaining two TM modes. These embodiments are particularly useful for parallel coupling. More specifically, an electrical field applied across the input probe 130 and the output probe 140 results in cross-coupling that defines a transmission zero, which in operation is manifest as one of an upper or lower passband limit for the RF filter. The data plots at FIGS. 5*a-b* respectively show examples of such lower passband limit and upper passband limit.

Figure 16:
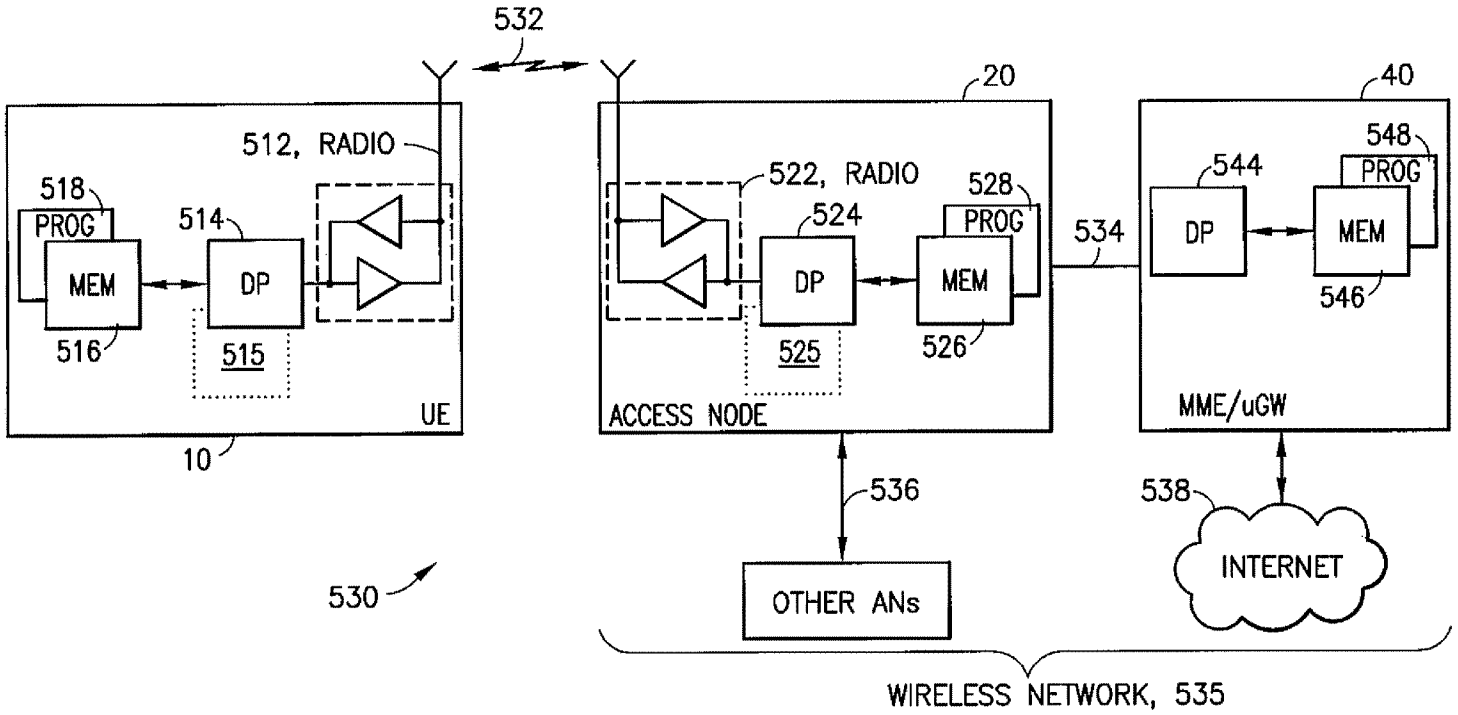
FIG. 16 is a high level schematic block diagram illustrating certain apparatus/devices in which certain embodiments of an RF filter according to these teachings might be advantageously disposed.

FIG. 16 is a high level diagram illustrating some relevant components of various communication entities that may implement an RF filter according to these teachings, including a base station identified generally as a radio network access node 20, and a user equipment (UE) 10. For completeness FIG. 16 also shows a mobility management entity (MME) which may also be co-located with a user-plane gateway (uGW) 40, but some radio networks may have different core network infrastructure. In the wireless system 530 of FIG. 16 a communications network 535 is adapted for communication over a wireless link 532 with an apparatus, such as a mobile communication device which may be referred to as a UE 10, via a radio network access node 20. The network 535 may include the MME/Serving-GW 40 that provides connectivity with other and/or broader networks such as a publicly switched telephone network and/or a data communications network (e.g., the internet 538).

The UE 10 includes a controller, such as a computer or a data processor (DP) 514 (or multiple ones of them), a computer-readable memory medium embodied as a memory (MEM) 516 (or more generally a non-transitory program storage device) that stores a program of computer instructions (PROG) 518, and a suitable wireless interface, such as radio frequency (RF) transceiver or more generically a radio 512 having a transmitter and a receiver (not separately labelled), for bidirectional wireless communications with the radio network access node 20 via one or more antennas. In general terms the UE 10 can be considered a machine that reads the MEM/non-transitory program storage device and that executes the computer program code or executable program of instructions stored thereon. While each entity of FIG. 16 is shown as having one MEM, in practice each may have multiple discrete memory devices and the relevant algorithm(s) and executable instructions/program code may be stored on one or across several such memories.

In general, the various embodiments of the UE 10 can include, but are not limited to, mobile user equipments or devices, cellular telephones, smartphones, wireless terminals, personal digital assistants (PDAs) having wireless communication capabilities, portable computers having wireless communication capabilities, image capture devices such as digital cameras having wireless communication capabilities, gaming devices having wireless communication capabilities, music storage and playback appliances having wireless communication capabilities, Internet appliances permitting wireless Internet access and browsing, as well as portable units or terminals that incorporate combinations of such functions.

The radio network access node 20 also includes a controller, such as a computer or a data processor (DP) 524 (or multiple ones of them), a computer-readable memory medium embodied as a memory (MEM) 526 that stores a program of computer instructions (FROG) 528, and a suitable wireless interface, such as a RF transceiver or radio 522 (also with a transmitter and receiver that are not particularly labelled), for communication with the UE 10 via one or more antennas. The radio network access node 20 is coupled via a data/control path 534 to the MME 40. The path 534 may be implemented as an Si interface. The radio network access node 20 may also be coupled to other radio network access nodes via data/control path 536, which may be implemented as an X5 interface. The radio access node 20 may be implemented as a base station, eNB, gNB, access point AP, remote radio head, relay node, transmit-receive point TRP, and the like.

Embodiments of the RF filters described herein can be disposed in the transmitter and/or in the receiver of the access node's radio 522, and/or of the UE's radio 512. Multiple iterations of such an RF filter may be implemented in each such device 10, 20, particularly in the receiver and the transmitter of the access node 20 which may handle many more frequency bands simultaneously as compared to the UE 10. Generally it is expected the RF filters described herein would be implemented in what is known in the art as a RF front end, which is the chip that handles RF level processing in the radio and which interfaces to the antenna port or ports.

The MME 540 includes a controller, such as a computer or a data processor (DP) 544 (or multiple ones of them), a computer-readable memory medium embodied as a memory (MEM) 546 that stores a program of computer instructions (PROG) 548.

In certain embodiments where there is software control over the RF functionality, at least one of the PROGs 518, 528 is assumed to include program instructions that, when executed by the associated one or more DPs, enable the device to operate in accordance with exemplary embodiments of this invention. That is, various exemplary embodiments of this invention may be implemented at least in part by computer software executable by the DP 514 of the UE 10; and/or by the DP 524 of the radio network access node 20; and/or by hardware, or by a combination of software and hardware (and firmware).

For the purposes of describing various exemplary embodiments in accordance with this invention the UE 10 and the radio network access node 20 may also include dedicated processors 515 and 525 respectively.

The computer readable MEMs 516, 526 and 546 may be of any memory device type suitable to the local technical environment and may be implemented using any suitable data storage technology, such as semiconductor based memory devices, flash memory, magnetic memory devices and systems, optical memory devices and systems, fixed memory and removable memory. The DPs 514, 524 and 544 may be of any type suitable to the local technical environment, and may include one or more of general purpose computers, special purpose computers, microprocessors, digital signal processors (DSPs) and processors based on a multicore processor architecture, as non-limiting examples. The wireless interfaces (e.g., RF transceivers 512 and 522) may be of any type suitable to the local technical environment and may be implemented using any suitable communication technology such as individual transmitters, receivers, transceivers or a combination of such components.

A computer readable medium may be a computer readable signal medium or a non-transitory computer readable storage medium/memory. A non-transitory computer readable storage medium/memory does not include propagating signals and may be, for example, but not limited to, an electronic, magnetic, optical, electromagnetic, infrared, or semiconductor system, apparatus, or device, or any suitable combination of the foregoing. Computer readable memory is non-transitory because propagating mediums such as carrier waves are memoryless. More specific examples (a non-exhaustive list) of the computer readable storage medium/memory would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

A communications system and/or a network node/base station may comprise a network node or other network elements implemented as a server, host or node operationally coupled to a remote radio head. At least some core functions may be carried out as software run in a server (which could be in the cloud) and implemented with network node functionalities in a similar fashion as much as possible (taking latency restrictions into consideration). This is called network virtualization. "Distribution of work" may be based on a division of operations to those which can be run in the cloud, and those which have to be run in the proximity for the sake of latency requirements. In macro cell/small cell networks, the "distribution of work" may also differ between a macro cell node and small cell nodes. Network virtualization may comprise the process of combining hardware and software network resources and network functionality into a single, software-based administrative entity, a virtual network. Network virtualization may involve platform virtualization, often combined with resource virtualization. Network virtualization may be categorized as either external, combining many networks, or parts of networks, into a virtual unit, or internal, providing network-like functionality to the software containers on a single system.

What is claimed is:

1. A radio frequency (RF) filter comprising:

an electrical conductor defining an outer sphere;

a dielectric material defining an inner sphere disposed within the conductor outer sphere, wherein a spherical shape of at least one of the inner and outer spheres is interrupted by:

a first localized discontinuity in said spherical shape disposed along a first axis passing through a geometric center of the at least one of the inner and outer spheres; and a second localized discontinuity in said spherical shape disposed along a second axis passing through the geometric center, the second axis being perpendicular to the first axis; and at least a first electrical probe and a second electrical probe, each said probe extending through the conductor and being electrically insulated from the conductor, wherein the first localized discontinuity defines a more substantial disruption to the spherical shape than the second localized discontinuity, and wherein the spherical shape does not have a third localized discontinuity disposed along a third axis passing through the geometric center of the at least one of the inner and outer spheres, the third axis being mutually perpendicular to the first axis and to the second axis.

2. The RF filter according to claim 1, wherein the first localized discontinuity includes two localized discontinuities disposed along the first axis on opposed sides of the geometric center, and the second localized discontinuity includes two localized discontinuities disposed along the second axis on opposed sides of the geometric center.

3. The RF filter according to claim 1, wherein the RF filter is a first RF filter that is electrically connected in series with an identical second RF filter such that the second electrical probe of the first RF filter and the first electrical probe of the second RF filter form a half wavelength interconnect between the first and second RF filters.

4. The RF filter according to claim 1, wherein the electrical conductor defines a shell within which the dielectric material is suspended and separated therefrom by an air gap.

5. The RF filter according to claim 4, wherein each of the first and second localized discontinuities is implemented as at least one of:

a chamfer, bulge or depression in the shell, a chamfer, bulge or depression in the dielectric material, and an adjustable tuning screw passing through the outer sphere and terminating within the air gap.

6. The RF filter according to claim 5, wherein each of the first and second electrical probes defines an interior end that terminates within the air gap.

7. A radio frequency (RF) filter comprising:

an electrical conductor defining an outer sphere;

a dielectric material defining an inner sphere disposed within the conductor outer sphere, wherein a spherical shape of at least one of the inner and outer spheres is interrupted by:

a first localized discontinuity in said spherical shape disposed along a first axis passing through a geometric center of the at least one of the inner and outer spheres; and a second localized discontinuity in said spherical shape disposed along a second axis passing through the geometric center, the second axis being perpendicular to the first axis: and at least a first electrical probe and a second electrical probe, each said probe extending through the conductor and being electrically insulated from the conductor, wherein the electrical conductor is a conductive coating on said dielectric material and the spherical shape of both the inner and the outer spheres is interrupted by the first and the second discontinuities.

8. The RF filter according to claim 7, wherein each of the first and second localized discontinuities is implemented as at least one of:

a chamfer in the inner and the outer spheres, an adjustable timing screw passing through the outer sphere and into the inner sphere, a bulge in the inner and the outer spheres, and a depression in the inner and the outer spheres.

9. The RF filter according to claim 7, wherein each of the first and second electrical probes extend into the inner sphere of dielectric material.

10. A radio frequency (RF) filter comprising:

a sphere;

an input probe defining an interior end and an opposed exterior end; and an output probe defining an interior end and an opposed exterior end;

wherein the sphere has three orthogonal transverse magnetic (TM) modes, a first localized discontinuity along a first of the TM modes and a second localized discontinuity along a second of the TM modes; and wherein the interior end of each of the probes is disposed within the sphere or within a resonant chamber air cavity about the sphere, wherein the input probe and the output probe are disposed about the sphere such that an electrical field applied across them yields one of:

in-phase coupling of two of the three TM modes and out-of-phase coupling of the remaining TM mode; and in-phase coupling of one of the three TM modes and out-of-phase coupling of the remaining two TM modes, and wherein an electrical field applied across the input probe and the output probe results in cross-coupling that defines a transmission zero manifest as one of an upper or lower passband limit for the RF filter.

11. The RF filter according to claim 10, wherein the first and second localized discontinuities split resonant frequencies along the respective first and second TM modes so as to span a designated frequency band that passes through the RF filter.

12. A radio frequency (RF) filter comprising:

an electrical conductor defining an outer sphere;

a dielectric material defining an inner sphere disposed within the conductor outer sphere, wherein a spherical shape of at least one of the inner and outer spheres is interrupted by:

a first localized discontinuity in said spherical shape disposed along a first axis passing through a geometric center of the at least one of the inner and outer spheres; and a second localized discontinuity in said spherical shape disposed along a second axis passing through the geometric center, the second axis being perpendicular to the first axis; and at least a first electrical probe and a second electrical probe, each said probe extending through the conductor and being electrically insulated from the conductor, wherein the RF filter is a first RF filter electrically connected in series with an identical second RF filter such that the second electrical probe of the first RF filter is electrically connected to the first electrical probe of the second RF filter via at least one of:

one or more ceramic slab resonators each having a conductive coating; and one or more air coaxial resonators.

13. A radio frequency (RF) filter comprising:

an electrical conductor defining an outer sphere;

a dielectric material defining an inner sphere disposed within the conductor outer sphere, wherein a spherical shape of at least one of the inner and outer spheres is interrupted by:

a first localized discontinuity in said spherical shape disposed along a first axis passing through a geometric center of the at least one of the inner and outer spheres; and a second localized discontinuity in said spherical shape disposed along a second axis passing through the geometric center, the second axis being perpendicular to the first axis; and at least a first electrical probe and a second electrical probe, each said probe extending through the conductor and being electrically insulated from the conductor, wherein the RF filter is a first RF filter electrically connected in parallel with an identical second RF filter, wherein the inner sphere of the first RF filter defines a first diameter that is larger than a second diameter defined by the inner sphere of the second RF filter.

14. The first and second RF filters according to claim 13, wherein each of the first and the second RF filters are characterized by three transverse magnetic modes, and are coupled such that phases of the modes alternate.

15. The first and second RF filters according to claim 14, wherein the first RF filter is electrically connected in parallel with the second RE filter via two half-wavelength transmission line resonators.

16. The first and second RF filters according to claim 14, wherein the first RF filter is electrically connected in parallel with the second RF filter via two air coaxial resonators.

* * * * *